US006561732B1

(12) United States Patent
Bloomfield et al.

(10) Patent No.: US 6,561,732 B1
(45) Date of Patent: May 13, 2003

(54) DRIVING PIPE AND METHOD FOR THE CONSTRUCTION OF AN ESSENTIALLY HORIZONTAL PIPELINE

(75) Inventors: Thomas D. Bloomfield, Neetze (DE); Michael Welzel, Schenefeld (DE)

(73) Assignee: Meyer Rohr & Schacht GmbH, Luneburg (DE)

( * ) Notice: Subject to any disclaimer, the term of this patent is extended or adjusted under 35 U.S.C. 154(b) by 0 days.

(21) Appl. No.: 09/645,894

(22) Filed: Aug. 25, 2000

(30) Foreign Application Priority Data

Aug. 25, 1999 (DE) ..... 199 40 327

(51) Int. Cl.[7] ..... E02B 13/00; E01F 5/00; E03F 3/00

(52) U.S. Cl. ..... 405/43; 405/36; 405/46; 405/50; 405/124; 405/184; 138/125; 138/DIG. 7; 166/228; 52/302.1; 264/273

(58) Field of Search ..... 405/36–39, 40, 405/43–47, 50, 124–126, 154.1, 184.1; 138/DIG. 7, 125; 166/228, 233; 52/169.5; 239/542, 145; 210/747, 767; 264/262, 263, 273

(56) References Cited

U.S. PATENT DOCUMENTS

| | | | | | |
|---|---|---|---|---|---|
| 2,009,163 | A | * | 7/1935 | Chesley | 405/43 |
| 2,401,035 | A | | 5/1946 | Akeyson et al. | |
| 2,798,768 | A | * | 7/1957 | Babin | 405/45 X |
| 3,422,626 | A | * | 1/1969 | Hanrahan | 405/43 |
| 3,630,384 | A | * | 12/1971 | Toda | 210/506 |
| 3,753,352 | A | * | 8/1973 | McNally | 405/43 |
| 4,134,268 | A | * | 1/1979 | Elmore | 405/43 |
| 4,235,561 | A | * | 11/1980 | Peterson | 405/45 |
| 4,364,891 | A | * | 12/1982 | Saggese | 264/263 |
| 4,577,997 | A | * | 3/1986 | Lehto et al. | 405/43 |
| 4,624,319 | A | * | 11/1986 | Van der borght | 166/227 X |
| 4,811,790 | A | * | 3/1989 | Jennings, Jr. et al. | 166/228 X |
| 4,904,112 | A | * | 2/1990 | McDonald | 405/45 |
| 5,141,360 | A | * | 8/1992 | Zeman | 405/43 |
| 5,152,634 | A | * | 10/1992 | Maso | 405/45 |
| 5,656,176 | A | * | 8/1997 | Scott | 210/747 |
| 5,816,742 | A | * | 10/1998 | Cordewener | 405/43 |
| 5,836,716 | A | * | 11/1998 | Johnson et al. | 405/43 |
| 6,012,522 | A | * | 1/2000 | Donnelly et al. | |
| 6,202,750 | B1 | * | 3/2001 | Ohanesian | 166/236 |
| 6,352,108 | B1 | | 3/2002 | Meyer et al. | |

FOREIGN PATENT DOCUMENTS

| | | | | |
|---|---|---|---|---|
| DE | 1301300 | | 8/1969 | |
| DE | 1786014 | | 11/1971 | |
| DE | 7206442 | | 5/1972 | |
| DE | 3412096 | | 10/1985 | |
| DE | 36 16 445 C1 | | 8/1987 | |
| DE | 10031663 | * | 8/2001 | |
| EP | 1002906 | | 5/2000 | |
| JP | 02136428 | * | 5/1990 | 405/43 |

OTHER PUBLICATIONS

Von Dipl.–Ing. Hans J. Möller et al., "Polybetonrohre®*)—Herstellung und Anwendung" Beton—und Stahlbetonbau, pp. 113–116, (1969).

Dipl.–Geoökologe Burkard Lenze, "Einbau von Horizontalfilterbrunnen sowie–drainagen als Speizialanwendungsgebiet der HDD–Technik" Fachtechnik HDD–Verfahren, pp. 31–35, (1999).

Dipl.–Ing. Thomas D. Bloomfield, Oberhausen, "Abwasserkanäle und—leitungen aus Polymerbeton", Sonderdruck aus Tis . Tiefbau . Ingenieurbau . Strassenbau, (1994).

* cited by examiner

*Primary Examiner*—Jong-Suk (James) Lee
(74) *Attorney, Agent, or Firm*—Akin Gump Strauss Hauer & Feld, L.L.P.

(57) ABSTRACT

A driving pipe and method for the construction of an essentially horizontal pipeline, whose wall is made at least primarily of concrete polymer. At least sections of the wall of the concrete polymer pipe are made of a liquid-permeable filter material consisting of polymer-bound, gravel-like particles.

13 Claims, 2 Drawing Sheets

DRIVING PIPE AND METHOD FOR THE CONSTRUCTION OF AN ESSENTIALLY HORIZONTAL PIPELINE

BACKGROUND OF THE INVENTION

The invention relates to a driving pipe for the construction of an essentially horizontal pipeline, whose wall consists at least primarily of concrete polymer. Driving pipes of this kind are used, for example, in the construction of sewers, where a major advantage is that the lines can be laid without having to dig a trench.

The horizontal drilling method for the installation of horizontal supply and disposal lines and filtering wells without trenches is known. However, this method is relatively complex, since an additional drilling machine must be used and thus the driving and the installation of the line coordinated in terms of the technical and work-related conditions.

In contrast, the driving method uses the pipeline as a means of transmitting the forces required for driving. This enables substantially less expensive construction of the line, although the design of the driving pipes must cater to the driving forces to be transmitted. As a result of the use of concrete polymer pipes, the finished line meets all practical operating requirements, including those relating to resistance to aggressive liquids and thus to service life.

Up to now, only concrete polymer driving pipes with a closed wall have been used to construct supply and disposal lines, where the seepage of liquid from the surrounding soil, or other materials surrounding the pipeline, through the pipe wall is neither possible nor intended.

BRIEF SUMMARY OF THE INVENTION

Consequently, the object of the invention is to design a driving pipe of the type described in the opening paragraph, which can also be used as a filter pipe or drainage pipe, e.g. to collect seepage water.

The object is solved in that at least sections of the wall of the concrete polymer driving pipe are made of a liquid-permeable filter material consisting of gravel-like particles being bound by a binder-material, especially by a polymer.

It has been found that, despite the weakening caused by the perforations, it is possible to dimension the wall of the pipes in such a way that they are capable of absorbing and transmitting the respective maximum driving force that occurs.

Specifically, the wall of the concrete polymer pipe can be provided with several perforations, each of which is filled with the liquid-permeable filter material. These perforations can be holes, although they can also be strip-shaped perforations running in the longitudinal direction of the pipe, for example, each of which is filled with correspondingly strip-shaped filter material. The pipe may consist partially, substantially or completely of a concrete polymer material.

Further details of the invention are disclosed in the sub-claims.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

Several practical examples of the invention are illustrated in the drawings. The drawings show the following.

DETAILED DESCRIPTION OF THE INVENTION

Figure 1:
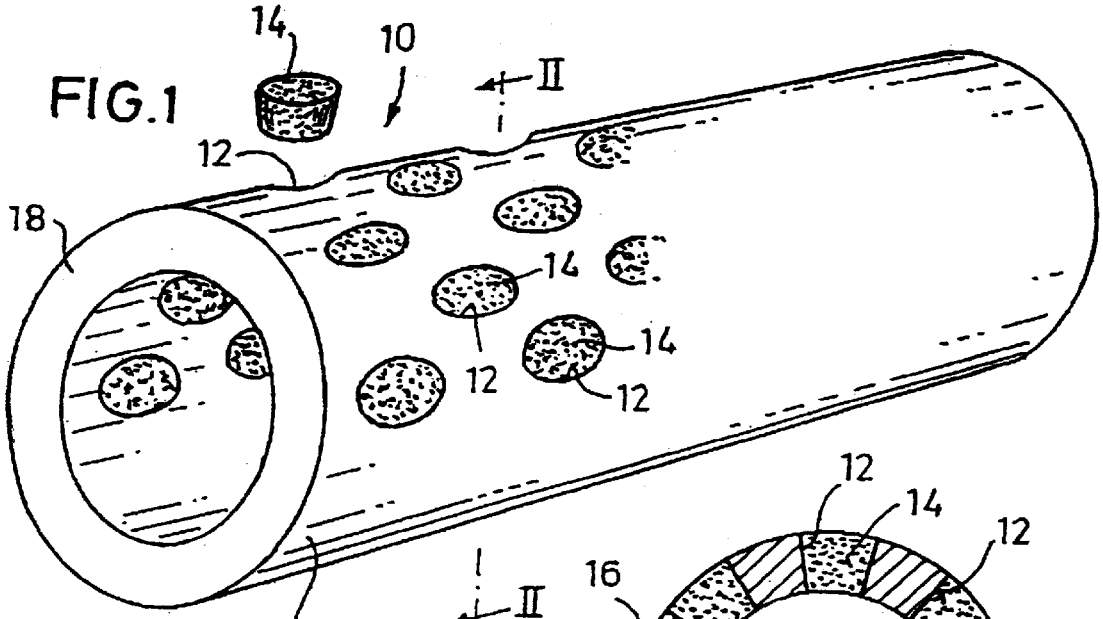
FIG. 1 A perspective view of a driving pipe designed as a filter or seepage pipe, FIG. 2 A section along Line II—II in FIG. 1, FIG. 3 A view of a second configuration corresponding to FIG. 1, FIG. 4 A view of a third configuration corresponding to FIG. 1
Figure 2:
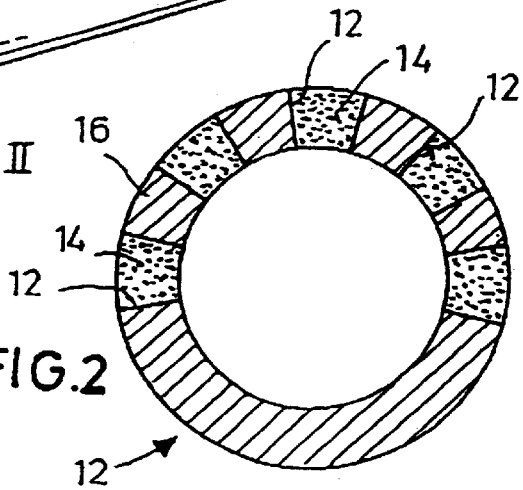

Driving pipe 10 shown in FIGS. 1 and 2 is provided with round holes 12, each of which is sealed by a plug 14 made of filter gravel. This plug 14 can be designed as a bonded gravel filter and consists of filter gravel and, for example, polyester or vinyl ester resin. These resins can also be used as the binders for the concrete polymer. This also applies to the following practical examples.

Filter plugs 14 have a void volume which allows the desired permeability for the liquid to be accommodated by pipe 10. The compressive strength of plugs 14 is much lower than that of the concrete polymer of the surrounding wall. This, however, is not a disadvantage, since wall 16 as a whole is dimensioned such that it is capable of absorbing the load acting at maximum driving force. For example, a driving pipe according to FIGS. 1 and 2 with an inside diameter of 400 mm and an outside diameter of 550 mm, i.e. a wall thickness of 75 mm, can be provided with holes whose maximum diameter is 2.54 cm. These holes are arranged in the longitudinal direction of the pipe at intervals of 10.0 cm, for example, where the individual rows are also spaced 10.0 cm apart in the circumferential direction. In this context, the arrangement is such that the holes of two adjacent rows are offset relative to one another, as shown in FIG. 1.

Face ends 18 of driving pipe 16 are designed in the usual manner of driving pipes. This also applies to the connecting elements for connecting two adjacent pipes and to any seals, etc. located between the two pipes. In this context, the generally standard and known designs and elements used to connect driving pipes for the construction of a pipeline can be provided and used. This also applies to the remaining practical examples described below.

Figure 3:
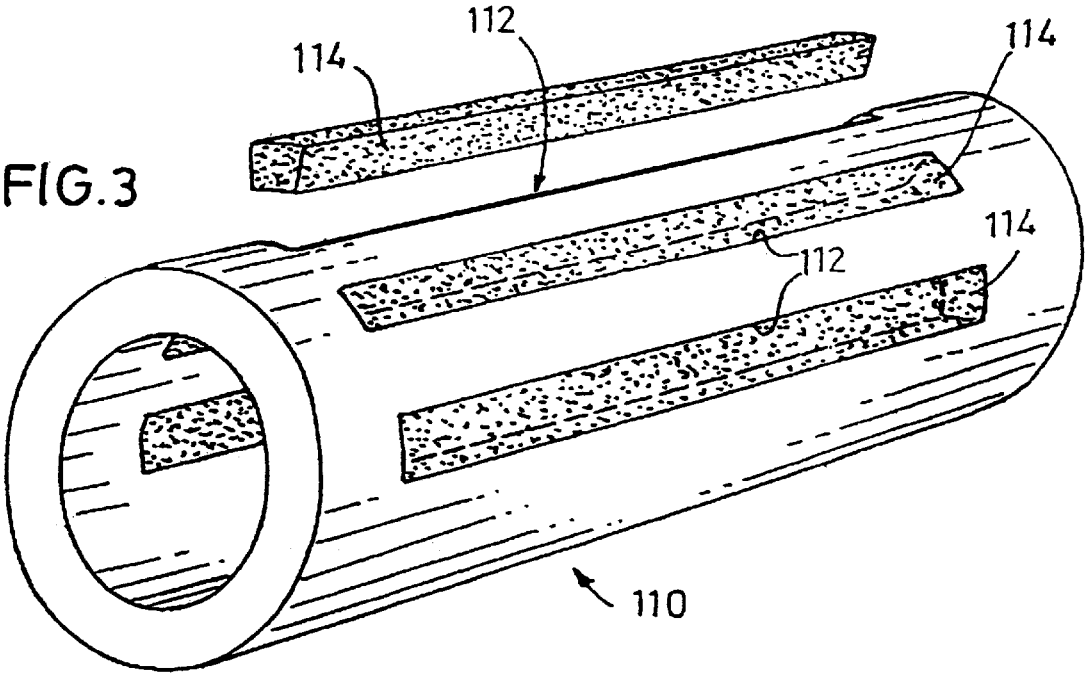

The practical example according to FIG. 3 essentially corresponds to that illustrated in FIGS. 1 and 2, so that identical or corresponding parts are also labelled with the same reference numbers, each of these being increased by 100 in FIG. 3.

Perforations 112 in pipe 110 in FIG. 3 are designed as strips running in the longitudinal direction of pipe 110, these being sealed by correspondingly strip-shaped elements 114 made of filter material. The drawing shows that perforations 112 taper from the outside surface towards the inside, so that filter element 114 is roughly in the form of a truncated wedge. The filter elements sealing the perforations in the pipe wall can be prefabricated and, for example, fixed to the pipe wall using an adhesive.

Figure 4:
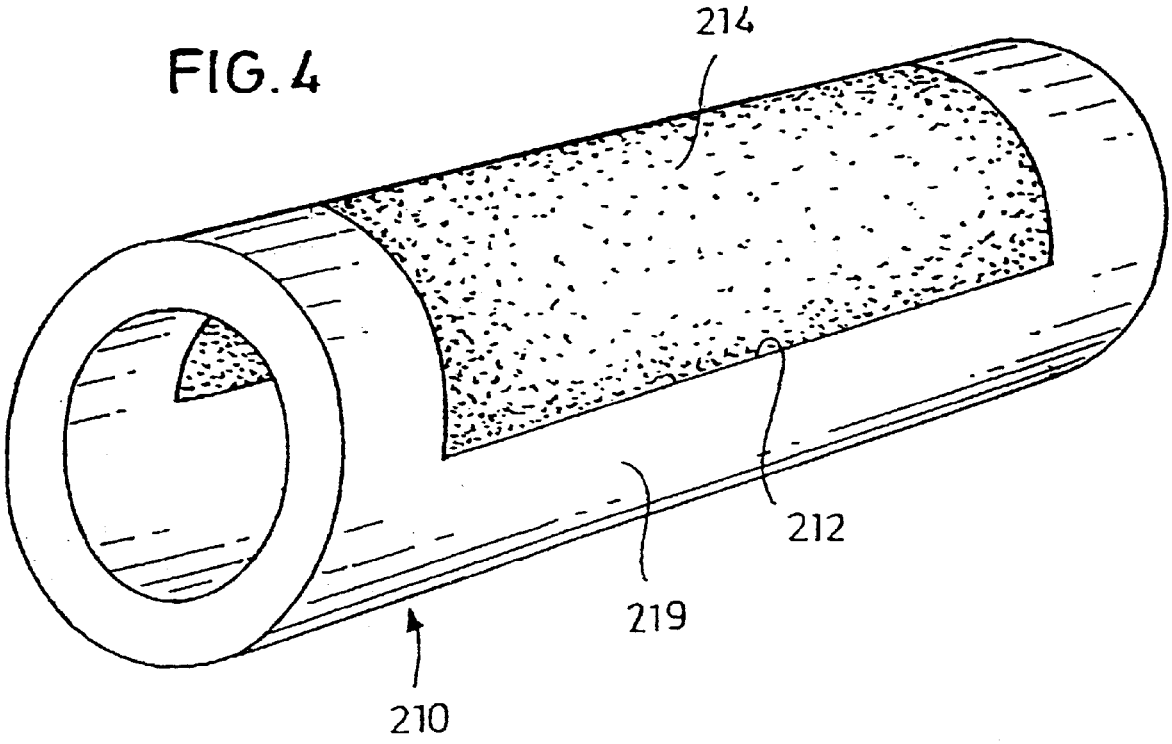

In the configuration according to FIG. 4, parts that match or correspond to those in the configuration according to FIG. 1 are labeled with the same reference numbers, increased by

200. In FIG. 4, the arrangement is such that recess 212 takes up a continuous, relatively large area extending, for example, over two-thirds of the length of pipe 210 and roughly 180° around pipe 210. Consequently, the filter material that fills recess 212 also forms a continuous element 214, which makes up a major part of the shell 219 of pipe 210. One advantage of this design can be that, when installing pipe 210 in the manner illustrated in FIG. 4, the lower region of the inside pipe cross-section forms a channel for liquid drainage that is not interrupted by filter areas, through which liquid could also escape from pipe 210 under certain circumstances. The respective conditions will determine which of the respective configurations should be considered.

The teaching according to the invention can be applied in many respects, as it has been found that perforated pipes with holes filled by plugs made of filter material, and/or pipes that are provided with differently shaped, possibly also large-area, perforations filled with filter material, can also be used as driving pipes, at least if the dimensions of the pipes and/or the arrangement of the perforations take the necessity of transmitting the driving forces into consideration. The driving pipes according to the invention are suitable, for example, for constructing seepage lines in landfills, but also for the construction of essentially horizontal filtering wells.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A driving pipe for the construction of an essentially horizontal pipeline, whose wall comprises a concrete polymer, wherein one or more sections of the wall of the concrete polymer pipe are made of a liquid-permeable filter material comprising gravel-sized particles being bound by a binder material, and wherein the wall of the pipe and the filter material of the one or more sections are formed to withstand the forces which occur during the driving process.

2. The driving pipe according to claim 1, wherein the wall of the concrete polymer pipe is provided with at least one perforation, which is filled by the liquid-permeable filter material.

3. The driving pipe according to claim 2, wherein the perforations are designed as essentially radially arranged holes, each of the holes being filled by a plug made of filter material.

4. The driving pipe according to claim 3, wherein the holes of the driving pipe are arranged in rows running in the longitudinal and circumferential directions and the holes in one row are offset relative to the holes in the two adjacent, parallel rows.

5. The driving pipe according to claim 4, wherein the holes have a diameter of roughly 2.5 cm.

6. The driving pipe according to claim 4, wherein the holes in one row are spaced roughly 10.0 cm apart in a pipe with an inside diameter of 400 mm.

7. The driving pipe according to claim 3, wherein the holes have a diameter of roughly 2.5 cm.

8. The driving pipe according to claim 2, wherein the at least one perforation is configured to be a strip-shaped perforation running in the longitudinal direction of the pipe essentially parallel to the longitudinal axis of the pipe, and wherein each of the perforations is filled by correspondingly shaped strips made of filter material.

9. The driving pipe according to claim 2, wherein the at least one perforation in the wall of the pipe tapers from the outside toward the inside.

10. The driving pipe according to claim 1, wherein the wall of the pipe is provided in its longitudinal direction with a circumferential section, which is closed and forms a continuous flow channel for the liquid seeping into the pipe.

11. The driving pipe according to claim 1, wherein the filter material also comprises concrete polymer.

12. A driving pipe for the construction of an essentially horizontal pipeline, whose wall comprises a concrete polymer, wherein one or more sections of the wall of the concrete polymer pipe are made of a liquid-permeable filter material comprising gravel-sized particles being bound by a binder material, and wherein the wall of the pipe and the filter material of the one or more sections are formed to withstand the forces which occur during the driving process, and wherein the filter material consists of the particles that are bonded by a polymer-binder.

13. A method for constructing a seepage pipeline for collecting and draining liquids from the material surrounding the pipeline comprising the step of constructing the seepage pipeline by the driving method, using driving pipes having a wall comprising concrete polymer, wherein one or more sections of the wall of the concrete polymer pipe are made of liquid-permeable filter material comprising gravel-sized particles being bound by a binder material, and wherein the wall of the pipe and the filter material of the one or more sections are formed to withstand the forces which occur during the driving process.

* * * * *